United States Patent [19]

Karp et al.

[11] Patent Number: 4,723,747

[45] Date of Patent: Feb. 9, 1988

[54] BAR HANGERS FOR RECESSED LIGHTING FIXTURES

[75] Inventors: Warren Karp, Woodland Hills; Frank Spitzer, Huntington Park, both of Calif.

[73] Assignee: Capri Lighting, Calif.

[21] Appl. No.: 922,690

[22] Filed: Oct. 24, 1986

[51] Int. Cl.[4] ..... A47F 1/10

[52] U.S. Cl. ..... 248/298; 248/57; 362/365

[58] Field of Search ..... 362/365, 371; 248/342, 248/343, 57, 298, 295.1; 403/109, 104

[56] References Cited

U.S. PATENT DOCUMENTS

| | | | |
|---|---|---|---|
| 1,156,885 | 10/1915 | Caine | 248/298 |
| 2,933,549 | 4/1960 | Antonucci | 248/298 |
| 4,566,057 | 1/1986 | Druffel | 362/365 |

*Primary Examiner*—Carroll B. Dority, Jr.
*Attorney, Agent, or Firm*—John E. Wagner

[57] ABSTRACT

An extensible bar hanger assembly designed to support recessed lighting fixtures in a ceiling. A pair of double L shaped bar members, one on each side of a fixture, are extensible and contractable to adjust between ceiling joists or other ceiling support to provide a rigid mount for the fixture. The bar members are each longitudinally domed to provide interlocking and each include an elongated slot extending the major length of each respective bar. One end of each bar includes a side extending barbed tab which is secured to adjacent ceiling joists. The opposite ends of the bar members include precisely formed locks. In the case of one bar member, the lock is an offset T shaped foot. The other end lock is a trapezoidal shaped head. These ends lock the joints together by interlocking through the elongated slots in the opposite bar member.

8 Claims, 8 Drawing Figures

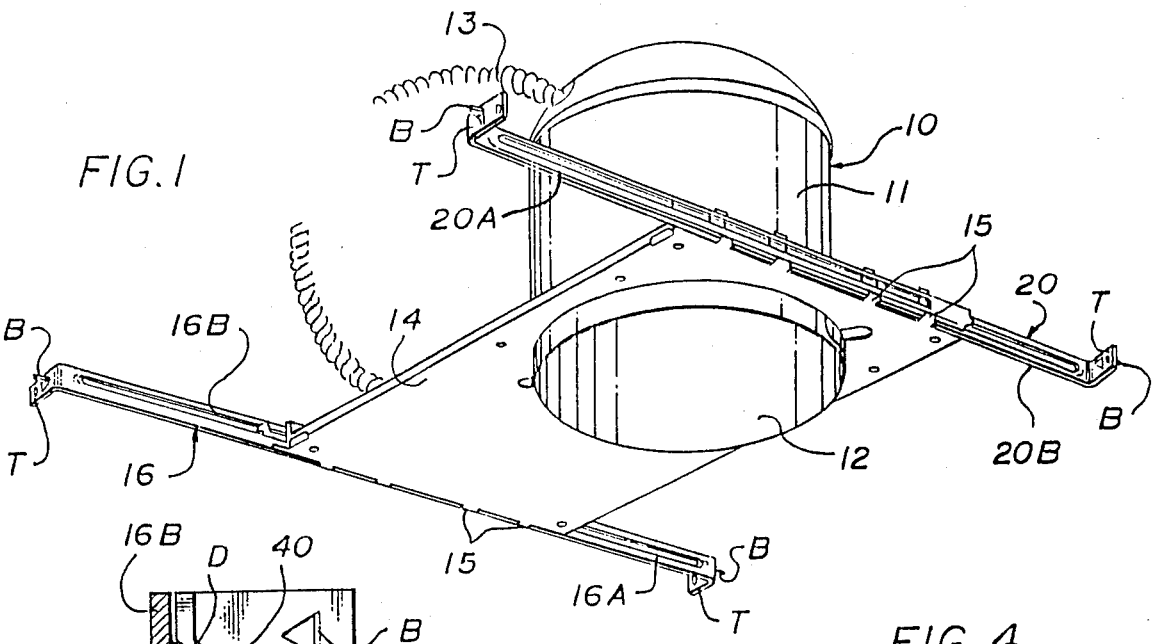
FIG. 1
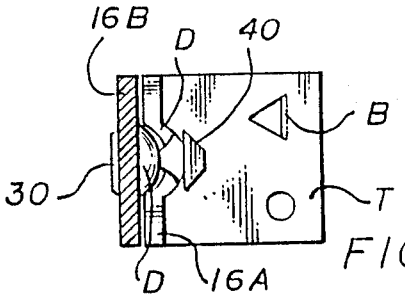
FIG. 6
FIG. 4
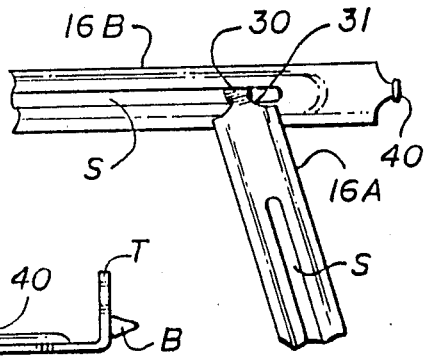
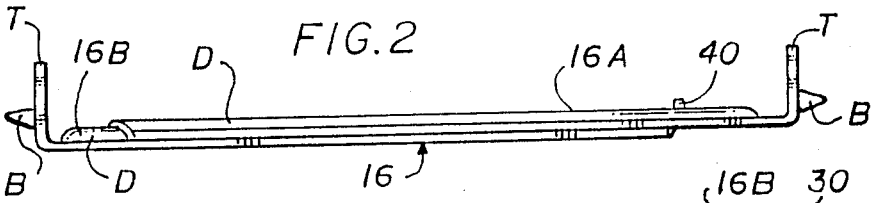
FIG. 2
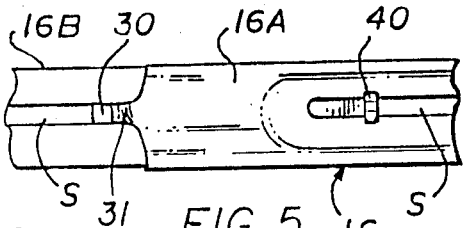
FIG. 5
FIG. 3
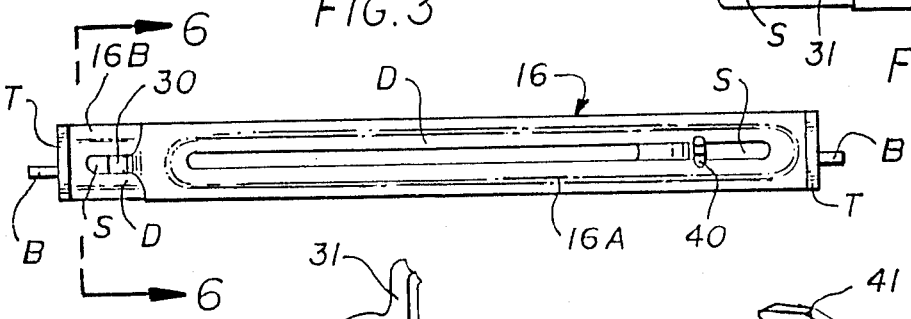
FIG. 7
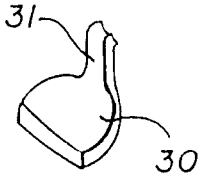
FIG. 8
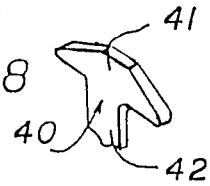

BAR HANGERS FOR RECESSED LIGHTING FIXTURES

BACKGROUND OF THE INVENTION

The recessed incandescent lighting fixture has achieved a high degree of acceptance for use in commercial installations, offices and homes where effective lighting is required without visibly intruding into the room. These fixtures are concealed within the ceiling and present only an attractive trim surface to the room below along with a light pattern depending upon the requirements of the user. Suitable lens and louvres often conceal the lamp from view.

Mechanical installation of the recessed lighting unit is usually accomplished by means of some support bridging between a pair of adjacent ceiling joists. In the past, two general types of hangers have been used. Classically, a U-shaped bar approximately ⅜ of an inch by ⅛ with end feet have been used to support various types of lighting fixtures. The end feet rest in notches on the top of joists and the fixture is secured to the bottom of the U at various screw holes. This type of recessed fixture support had several disadvantages, one being that the installation time was unnecessarily long since the installer had to chisel 4 notches in the four joists. Also, the installer had to have access to the top of the ceiling joists.

More recently hanger bars have been built as part of the fixture. Typically these hanger bars include a pair of bars members, each with an end foot bent horizontally to engage the inner faces of ceiling joists. Typically the two hanger bars overlap and include saw tooth notches in the top edge. The installer extends the two hanger bar members into engagement with the joists, nails them to the joists and then crimps fingers built into the fixture frame into the saw tooth edges to hold the fixture in place. Typically such hangers did not provide adequate support in the vertical direction causing fixtures to sag, and did not allow full freedom of the adjustment of the fixture from one edge of the inter-joist space to the other. Typically these hangers were located at varying distances above the plane of the lower edge of the joists so they could not be used as a guide to the vertical location of the fixture. Installation of recessed fixture, if not at the appropriate position vertically and in the plane of the ceiling, provided an unattractive installation.

BRIEF DESCRIPTION OF THE INVENTION

Faced with the foregoing state of the art of bar hangers for recessed fixtures, we examined the real needs for fixture hangers and determined that (1) they must be relatively, rigid, (2) they must allow the fixture to be located at any position between the two joists or adjacent structural members, (3) they must be easily installed and easily adjusted, and (4) they must provide a reference for vertical displacement of the hanger.

Each of these features should be obtained in the combination of this invention. It comprises a pair of hanger bars, each having a longitudinally extending dome providing beam stiffness, and each having a longitudinally extending slot in the to of the dome adapted to receive interlocking ends of the hanger bars. These interlocking ends are in two different forms. On the outer bar, the interlocking end is an offset foot having a width greater than the slot and and ankle portion approximating the slot width. The interlocking end of the second bar is trapezoidally shaped extending normal to the plane of the bar and includes a throat portion which approximates the width of the slot in the outermost bar.

The bars of this invention are assembled by placing them at an angle with respect to each other, inserting the foot through the slot of the opposite bar, turning the two bars into alignment and snapping the trapezoidal lock through the slot in the outer bar by deflecting the bar to temporarily provide a wider opening. When the two bars are thus assembled, they may be moved to the width of the space between the two adjacent joists or other supports. The angle and throat portions engage the other hanger bar and prevent sliding after once being moved into position. The hanger bar is secured at the lower edge of the fixture frame so that the lower edge of the hanger bar defines the plane of the fixture. The hanger bars, being domed and interleaved, provide beam strength, and the fact that the upper and lower edges define a continuous unobstructed surface allows the fixture to be moved fully against either edge of the inter-joist spacing.

BRIEF DESCRIPTION OF THE DRAWING

This invention may be more clearly understood from the following detailed description and by reference to the drawing in which:

FIG. 1 is a perspective view from beneath of a fixture employing the hanger bars of this invention;

FIG. 2 is an bottom view of the hanger bar assembly of FIG. 1;

FIG. 3 is an outer side elevational view thereof;

FIG. 4 is a fragmentary side elevational view of the hanger bars of this invention in the process of being assembled;

FIG. 5 is a fragmentary side elevational view of the hanger bars of FIGS. 1–4 as assembled;

FIG. 6 is a vertical sectional view taken along line 6—6 of FIG. 3

FIG. 7 is a fragmentary view of the foot locking member of this invention; and FIG. 8 is a fragmentary perspective view of the trapezoidal locking member of this invention.

DETAILED DESCRIPTION OF THE INVENTION

Now referring to FIG. 1, a recessed lighting fixture generally designated 10 may be seen including a domed canister 11 open at its lower end to provide a light emitting opening 12. The lighting fixture contains an internal lamp holder (unshown) which is powered via conduit 13. The fixture 10 includes a plaster frame or base plate 14 having a plurality of integral finger 15 employed to secure the fixture mechanically to a pair of extensible hanger bar members generally designated 16 and 20. Both hanger bar members 16 and 20 are made up of a pair of respective hanger bar parts 16A, 16B, 20A and 20B.

The hanger bars 16 and 20 of this invention may be more easily seen in FIGS. 2 and 3. Bar members 16A and 20A are identified as the outer bars, and bar members 16B and 20B as the inner bars. Both bar sets 16 and 20 include end tabs T, each with the respective integral barbs B. Both bar sets are domed at D and when nested add beam strength which is represented by the overlapping appearance shown in FIG. 6.

Referring to FIGS. 2, 3 and 7, the bar members 16A and 16B are almost fully retractable to approximately the length of a single member, and extendable to nearly double their length. The bars 16A and 16B are interlocked in part by the foot 30, not seen in FIG. 2 but best seen in FIGS. 3, 4, 5 and 7. This foot 30 has a width greater than the width of the slot S of bar member 16B, and approximately the thickness of the bar 16A, (e.g. 16 gauge galvanized steel) and is lesser in width at its ankle portion 31 than the width of slot S of bar member 16B. Therefore, the foot 30 may be inserted through the slot S in bar member 16B as shown in FIG. 4, and when the bars 16A and 16B are aligned, the width of the foot 30 is sufficient to engage both sides of the slot S in bar member 16B. The ankle portion 31 of the locking foot 30 is approximately the width of the slot S in bar member 16B so that it engages the edges of slot S in bar member 16B in sliding fit whenever the bars 16A and 16B are aligned as shown in FIGS. 2, 3 and 5.

The second locking element of the bar 16A is the trapezoidal or truncated arrowhead member 40 appearing in FIGS. 2–6 and 8. This locking member 40 has a head portion 41 broader than the width of slot S in bar member 16A and has its side walls tapered by the non-parallel trapezoidal edges. The throat portion 42 approximates the width of the slot S in bar member 16A. The head 41 may be forced through slot S in bar member 16A as described below to lock the members 16A and 16B together.

We have found that the long domed bar members 16A and 16B and with the locking means to hold the two bar members together, provides beam strength sufficient to more than overcome the weakness introduced by the elongated slots. Likewise, having such an elongated slot means that the head 40 can be snapped through the slot S in bar member 16A easily since the bar 16A can temporarily distorted slightly to allow the head 40 to snap through the slot S in bar member 16A to be retained there virtually permanently once the assembly is introduced into the plaster frame 14 where the bar members are held together further by the fingers 15.

We have thus achieved, in a simple structure, a relatively rigid hanger member which is extendible to nearly double it's length and one which is free of interference with the fixture so that the fixture may be moved fully to one end or the other of the inter-joist space. The hanger bar members are of simple construction and with their domed top and interlocking tabs provide rigidity, particularly in the vertical direction, which is necessary for effective mounting of a recessed fixture. Their continuous, uninterrupted lower surface provides a reference line for installation of a precise height in the ceiling.

The bar parts are assembleable by the simple procedure of touch, turn and lock. This can be accomplished by merely inserting one bar member through the retaining fingers of the fixture 10, extending its inner end beyond the last finger, inserting the end tab of the foot 30 through the slot S in bar member 16B, pivoting the bar 16A into alignment with bar 16B, snapping the head 40 through the slot S in bar member 16A and sliding the now assembled bars 16A and 16B to the appropriate position with respect to the fixture. The integral finger 15 may be crimped if desired to rigidly locate the fixture 10 on the hanger bar. A single tap with a hammer of the tabs T into the joist followed by a securing nail is all that is required to mechanically mount the fixture. Simplicity yet effectiveness in recessed lamp hangers has not been achieved prior to this invention.

This invention shall not be limited to the illustrative embodiment but rather to the claims as set forth below which constitute definitions of this invention including the protection afforded by the doctrine of equivalents.

What is claimed is:

1. A hanger bar assembly for recessed lighting fixtures, comprising:

a first hanger bar member including a first end adapter for securement to a ceiling support and a second end including locking means including a foot integral with said hanger bar;

a second hanger bar member including a first end adapter for securement to a ceiling support and a second end including locking means including a head integral with said second hangar bar;

said first and second hanger bar members including respective slot type openings in the length thereof;

the locking means of said first and second hanger bar members extending through the opening in the other respective hanger bar member to secure the hanger bar members together;

said foot and said head of said locking means being wider than said slot type openings.

2. An extensible hanger bar assembly in accordance with claim 1 wherein said locking means can engage the other member at any position along the length of said slot type openings.

3. A hanger bar assembly in accordance with claim 1 wherein said locking means comprise upstanding portions extending through the slot type opening of the opposite bar member and engaging the edges of said slot type openings to lock the bar members together.

4. A hanger bar assembly in accordance with claim 1 wherein said foot is connected to its hanger bar by an ankle portion of width approximating the width of said slot type openings;

said hanger bar member having a thickness less than the width of said slot type openings whereby said ankle and foot portions of said bar member may be inserted through said slot type openings at an approximately ninety degree angle with respect to said opposite bar member length and said bar members interlocked by turning said bar members into alignment with said ankle portions extending through the slot type opening in the opposite bar member.

5. The hanger bar assembly in accordance with claim 4 wherein said head is tapered to be forced through the opening into locking engagement.

6. The hanger bar assembly in accordance with claim 1 in which said hanger bar members are domed whereby the first and second bars may be nested and held in nested relationship by said locking means.

7. The hanger bar assembly in accordance with claim 6 wherein the domed portions extend along a major portion of the length of each of said hanger bars.

8. The hanger bar assembly in accordance with claim 6 in which said openings are in the domed portion of said hanger bar members.

* * * * *